United States Patent [19]

Setescak

[11] 4,237,436

[45] Dec. 2, 1980

[54] CIRCUIT BREAKER HAVING A MODIFIED ARMATURE FOR TIME DELAYS AT HIGH TRANSIENT CURRENTS

[75] Inventor: Edward J. Setescak, West Windsor, N.J.

[73] Assignee: Heinemann Electric Company, Trenton, N.J.

[21] Appl. No.: 3,522

[22] Filed: Jan. 15, 1979

[51] Int. Cl.[3] ..... H01H 7/08

[52] U.S. Cl. ..... 335/63; 335/59; 335/239

[58] Field of Search ..... 335/63, 64, 59, 241, 335/239

[56] References Cited

U.S. PATENT DOCUMENTS

| | | | |
|---|---|---|---|
| 3,497,838 | 2/1970 | Merriken et al. | 335/64 |
| 3,959,755 | 5/1976 | Harper et al. | 335/59 |
| 4,062,052 | 12/1977 | Harper et al. | 335/63 |

*Primary Examiner*—Harold Broome

*Attorney, Agent, or Firm*—Joseph G. Denny, III; Peter J. Patane

[57] ABSTRACT

An electromagnetic circuit breaker comprising a solenoid coil and an armature actuatable by the coil. A tube of nonmagnetic material within which is a movable magnetizable core, the tube having a pole piece at one end toward which the armature is attracted on predetermined overload conditions, the core being biased toward the end of the tube away from the pole piece.

An inertial mass is carried by the armature and is pivotally and eccentrically connected to a link at one end. The link has another end pivotally mounted to a fixed support.

Thus, when the armature is attracted to the pole piece the inertial mass is caused to rotate at an angular velocity greater than the angular velocity of the armature, so that the current in the coil required to overcome the bias on the armature with substantially no time delay, when the gap between the core and the pole piece is at its maximum, is substantially higher than the current required for a similar device but which omits the inertial mass.

7 Claims, 7 Drawing Figures

FIG. 3
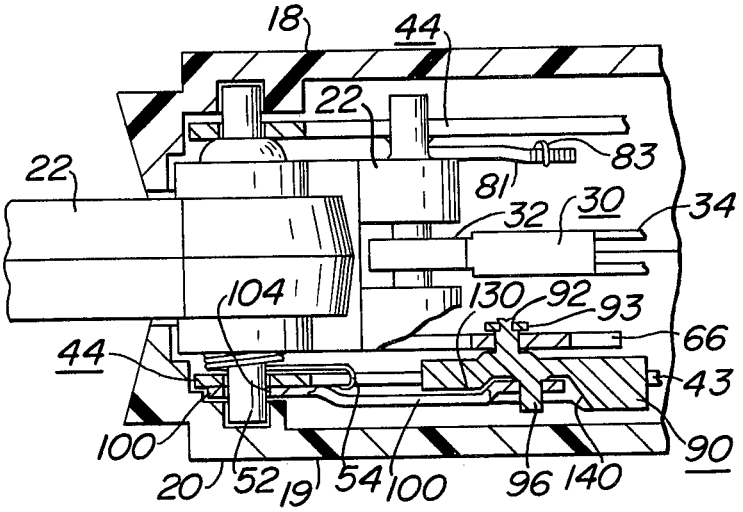
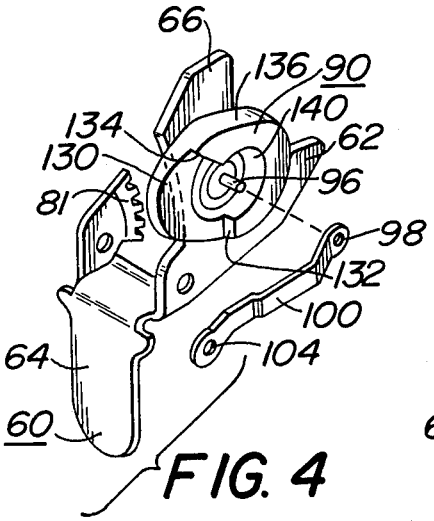
FIG. 4
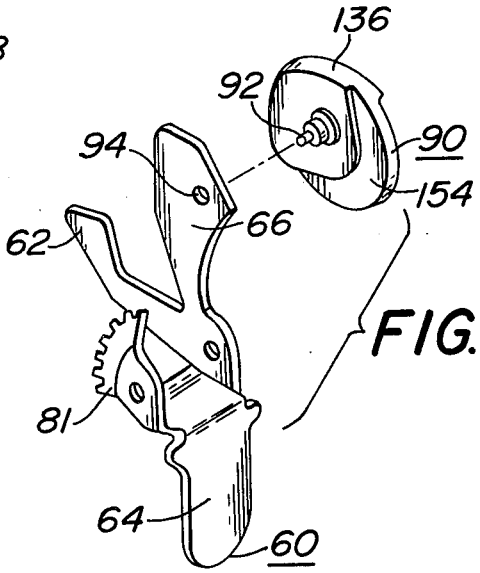
FIG. 5

FIG. 6
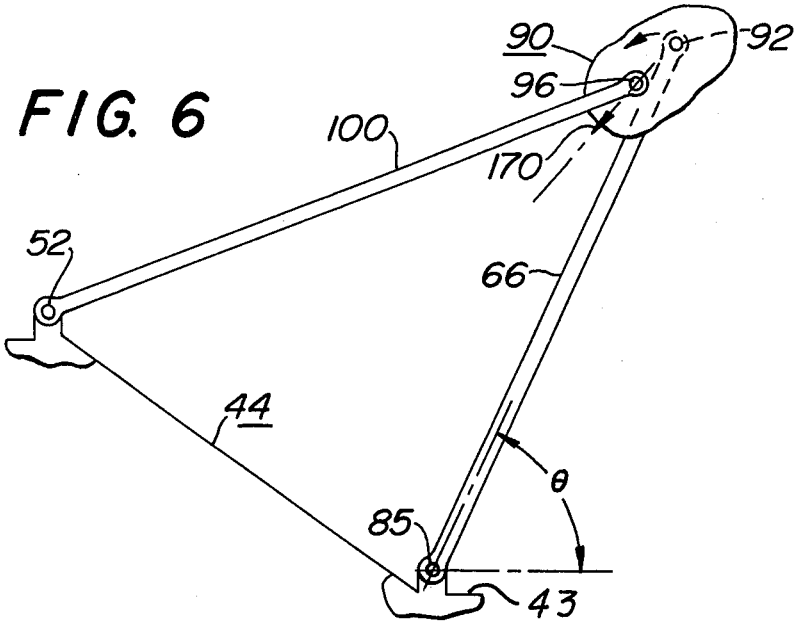
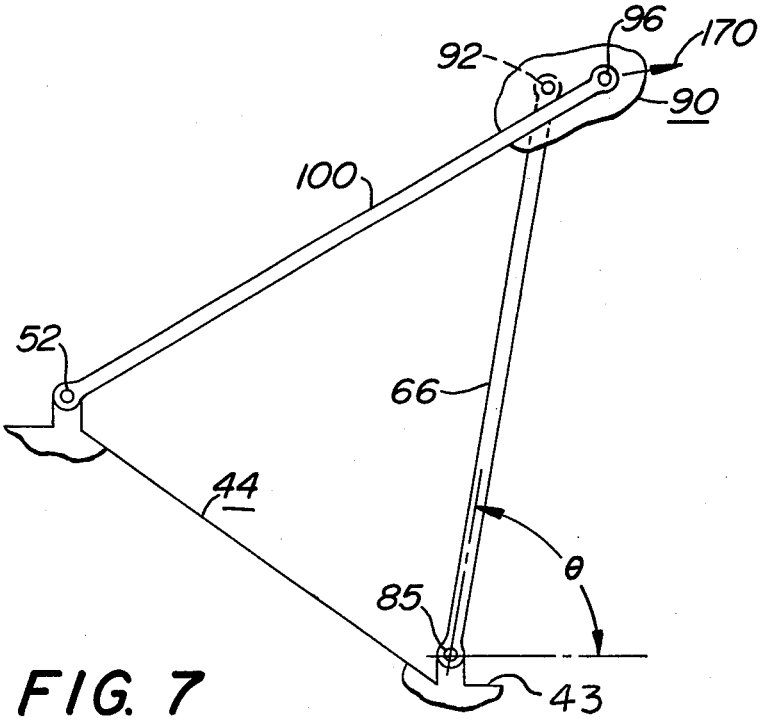
FIG. 7

CIRCUIT BREAKER HAVING A MODIFIED ARMATURE FOR TIME DELAYS AT HIGH TRANSIENT CURRENTS

BACKGROUND OF THE INVENTION

This invention relates to electromagnetic circuit breakers in which overload sensing is accomplished electromagnetically by a device which permits the circuit breaker to actuate after a time delay period at certain overloads and with substantially no time delay at other overloads. Such devices are illustrated, for example, in U.S. Pat. Nos. 2,360,922 and 3,329,913. These prior art patents disclose electromagnetic sensing devices including a solenoid coil, a time delay tube housing a movable core of magnetizable material movable against the retarding action of a liquid and a pivotal, spring biased, armature. In these devices a time delay is provided upon the occurrence of an overload which, if below a certain value and if it does not persist for a perdetermined time, will not cause the pivoting of the armature and, hence, will not open the circuit breaker contacts, thereby avoiding nuisance tripping. However, in these circuit breakers, if the overload current in a circuit breaker is sufficiently high, the resulting magnetic flux will substantially instantaneously cause the pivotal armature to pivot and, hence, trip the toggle linkage, thereupon opening the circuit breaker contacts substantially instantaneously, i.e., with no intentional time delay.

However, certain electrical loads may safely accept a very high current, usually an inrush current which is a substantially momentary current, i.e., of very short duration, so that at such currents no tripping of the circuit breaker may be desired.

Several attempts have previously been made to modify these known electromagnetic devices to permit the flow through the circuit breaker or relay of ever higher inrush currents, of short durations, without tripping the circuit breakers or the relays, as disclosed in U.S. Pat. Nos. 3,307,130; 3,272,934; 3,517,357 and 3,497,838. It is an object of this invention to provide another arrangement whereby the electromagnetic device will permit the flow therethrough of high inrush currents which are of short durations, without tripping the circuit breakers or relays.

BRIEF SUMMARY OF THE INVENTION

This invention is embodied in an electrical circuit breaker comprising a case enclosing separable contacts actuatable by a toggle linkage. The toggle linkage, on predetermined current conditions, is tripped by a pivotal armature. The armature forms part of the electromagnetic device which further comprises a frame and a solenoid coil. The solenoid coil surrounds a tube housing a core of magnetized material which is biased toward one end, the rear end, of the tube. The other, or forward, end of the tube includes a magnetizable pole piece toward which the core moves upon sufficient energization of the coil, and the armature is biased away from the pole piece.

The armature comprises three legs. One leg is attracted to the pole piece, a second leg unlatches the toggle linkage and the third leg substantially balances the other two legs.

In accordance with this invention, the third leg pivotally carries an auxiliary inertial mass or rotor. The inertial mass is also pivoted (at a distance spaced from its pivotal connection with the balance leg but along an axis parallel thereto) to one end of a link which has its opposite end pivotally connected to a fixed support disposed within the circuit breaker case.

Thus, the pivotal connections of the inertial auxiliary mass to the third leg and to the link results in the amplification of the motion of the auxiliary mass relative to the motion of the armature, i.e. a certain angular motion of the armature requires the auxiliary mass to undergo a much greater angular motion. Depending on the physical placement of the auxiliary mass on the third leg and on the length and placement of the link, a ratio of about 9 to 1 between the angular motion of the auxiliary mass and of the armature has been obtained in certain circuit breakers.

The magnetic force tending to pivot the armature through a certain angle must at the same time pivot the auxiliary mass through a much greater angle, because of this arrangement. If the magnetic force has been created by a transient current of short duration, the current will have diminished before the movement of the auxiliary mass is completed, and the armature will have pivoted insufficiently to trip the toggle linkage.

The foregoing and other objects of this invention, the principles of this invention, and the best modes in which I have contemplated applying such principles will more fully appear from the following description and accompanying drawings in illustration thereof.

BRIEF DESCRIPTION OF THE VIEWS

In the drawings,

FIG. 3 is a partial sectional view taken along the line 3—3 in FIG. 2 but enlarged relative to FIG. 2;

FIG. 4 is a perspective view of the armature, the auxiliary inertial mass and the link for the latter, showing the link spaced therefrom at approximately the scale of FIGS. 1 and 2;

FIG. 5 is a perspective view similar to FIG. 4 but viewed from the back relative to FIG. 4 and showing only the inertial mass and the armature;

FIG. 6 is a diagrammatic view of the armature's third or balancing leg, the auxiliary inertial mass, the link and the frame in the fully unattracted position of the armature; and FIG. 7 is a diagrammatic view similar to FIG. 6 but showing the fully attracted position of the armature .

DESCRIPTION

Figure 1:
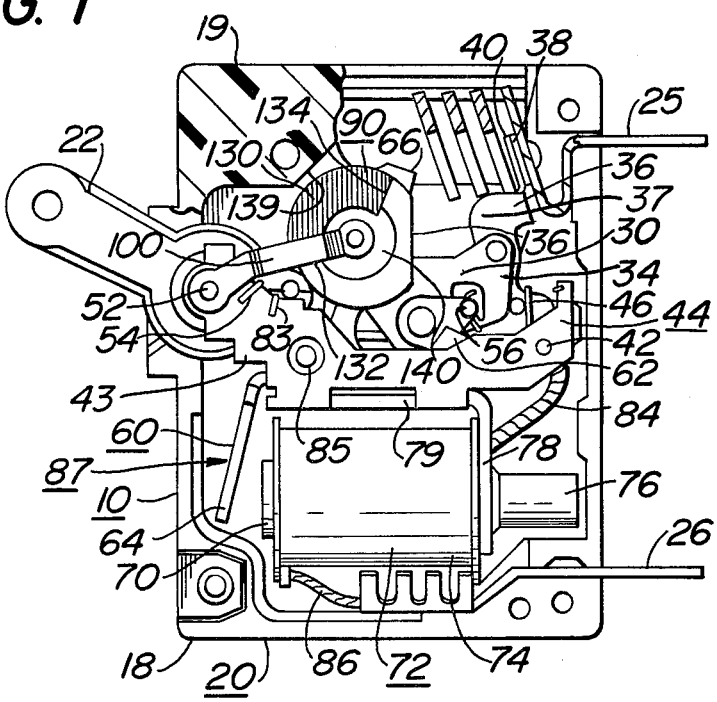
FIG. 1 is a side elevation, illustrating a circuit breaker incorporating this invention, with one of the half-cases cut away and partially sectioned to show the general internal arrangement and illustrating the contacts in the closed position.

Referring to the drawings, FIG. 1 illustrates a circuit breaker 10 generally similar to the one disclosed and claimed in U.S. Pat. No. 3,329,913. For a more complete description of this circuit breaker reference should be made to the aforementioned patent, but for clarity the circuit breaker may be described as comprising an insulating case 20 formed by abutting half-cases 18 and 19, an operating handle 22, and terminals 25 and 26 for connecting the circuit breaker 10 to a load. Pivotally connected to the handle 22 is a toggle linkage 30 and a movable arm 36 is pivotally connected to the latter, the handle 22, the toggle linkage 30 and the movable arm 36 jointly comprising the operating mechanism 37 of the circuit breaker 10. The terminal 25 supports a stationary contact 38 which cooperates with a movable contact 40, the latter being carried by the movable arm 36. The movable arm 36 pivots about a pintle 42, carried by a frame 44, and is biased by a spring 46 to the open position of the contacts 38 and 40.

The toggle linkage 30 (comprising left link 32 and right link 34, FIG. 3) is pivotally connected at its right end to the movable arm 36 and at its left end to the handle 22. The handle 22 oscillates about a fixed pintle 52 which is carried by the frame 44 and is biased to the "off" or open position of the contacts 38 and 40 by a reset spring 54, the spring 54 also automatically resetting the toggle linkage 30 after it has collapsed.

Figure 2:
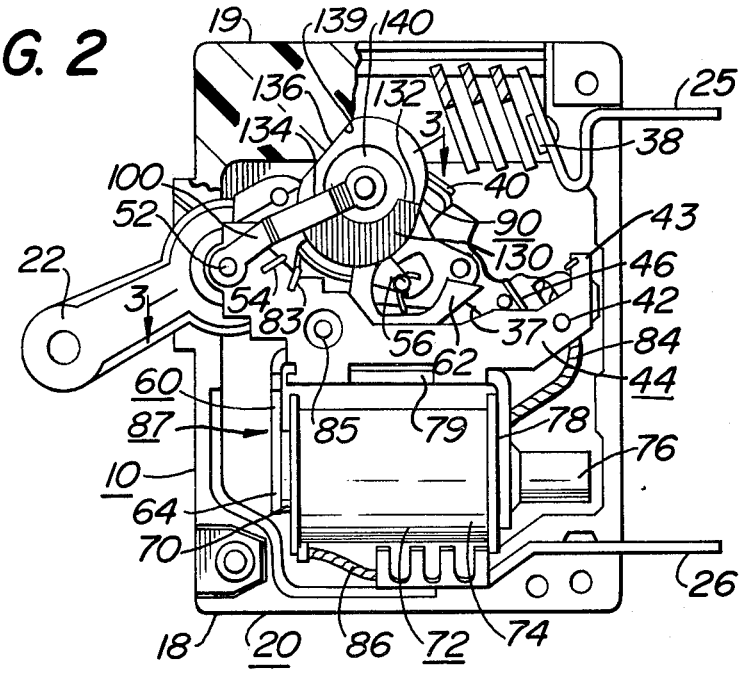
FIG. 2 is a side elevation similar to FIG. 1 but showing the armature fully attracted to the pole piece and the contacts open position.

For locking the toggle linkage 30 in the overcenter position during automatic resetting, the toggle linkage 30 includes a latch mechanism comprising a spring biased latch 56 carried by the right toggle link 34, as partially seen in FIGS. 1 and 2.

The latch 56 is tripped by a pivotal armature 60 having three legs, namely a first or unlatching leg 62, a second or attractable leg 64 and a third or substantially balancing leg 66. The unlatching leg 62 engages the latch 56 and turns it to unlatch the toggle linkage 30, thereby allowing the toggle linkage 30 to collapse under the bias of the opening spring 46 when the attractable leg 64 is pivoted sufficiently toward the pole piece 70 of an electromagnet 72 (upon predetermined overload) to bring the unlatching leg 62 into engagement with the latch 56. To adjust the spring bias on the armature 60, the armature 60 includes, as shown in FIGS. 4 and 5, a serrated cock's comb or leg 81 into the notches of which one end of the spring 83 is placed to vary the bias of the armature spring 83 upon the armature, the other end of the spring 83 being hooked around the frame 44. Further, the armature 60 pivots about a pin 85 carried by the frame 44, all as is well known in the prior art.

The electromagnet 72 comprises a solenoid coil 74 about a tube 76, the latter projecting through a vertical leg 78 of the frame 44 whose horizontal leg 79 extends longitudinally along the coil 74, as shown. The tube 76 is of non-magnetic material and houses a movable core (not shown) of magnetizable material biased by a spring (not shown) toward the right end of the tube 76 and is retarded in its upward movement by a liquid, preferably a silicone oil, within the tube 76 to provide a time delay below certain overload currents before tripping of the circuit breaker 10 takes place. The coil 74 has one end connected to the movable arm 36 by a flexible conductor 84 and the other end connected by a conductor 86 to the terminal 26. Thus, an electromagnetic tripping device or sensing element 87 is formed by the coil 74, the tube 76, the movable core within the tube 76, and the armature 60 for tripping the circuit breaker 10 after a time delay period at certain overloads or substantially instantaneously at higher overloads.

It has been found that the overcurrent at which the circuit breaker 10 will substantially instantaneously trip open the circuit breaker, i.e., the instantaneous trip point, for a circuit breaker of this type will be substantially higher if there is added to the electromagnetic sensing device 87 an auxiliary inertial mass or rotor 90 arranged so that it is pivoted by the armature 60 through an angle which is greater than the angle through which the armature 60 pivots when it is attracted to the pole piece 70. In the preferred embodiment, the mass 90 is added to the balancing leg 66.

The mass 90 includes an integral pintle 92 extending through a suitable hole 94 (FIG. 5) in the leg 66 and is pivotally carried thereby. The pintle 92 also carries a washer 93 and the end portion of the pintle 92 is peened over the washer to pivotally retain the mass 90 to the leg 66, as shown in FIG. 3.

The other side of the auxiliary inertial mass 90 has a second integral pintle 96 (FIG. 3) which is offset or spaced from the pintle 92, as shown. The second pintle 96 extends through a suitable hole 98 (FIG. 4) in a link 100, the hole 98 being at the right end portion of the link 100, trapping the mass 90 between the link 100 and the balancing leg 66 (FIG. 3). The left end portion of the link 100 has another hole 104 through which pivotally extends a portion of the pin 52, as seen in FIG. 3, the link 100 being thus pivotally fixed at its left end portion to the frame 44 and trapped between the lower case 19 and the frame 44 while being pivotally carried by the pin 52. Thus, movement of the link 100 along the pin 52 is restrained. However, if desired, the pintle 96 could carry a fastener (not shown) to secure the link 100 thereto and thereby prevent any undesired movement of the link 100 along the axis of the pintle 96.

Since the part of the mass 90 between pintles 92 and 96 may be considered as a link, this invention can be viewed as adding to a known circuit breaker a four-bar linkage type of mechanism and FIGS. 6 and 7 are diagrammatically intended to illustrate this. The first bar of the four-bar linkage is diagrammatically indicated as the balancing leg 66 which is pivoted to the mass 90 at the pintle 92. The part of the mass 90 between the pintle 92 and the pintle 96 is the second bar of the four-bar linkage. The third bar of the linkage is the link 100. Since the pins 52 and 85 are carried by the fixed frame 44, the fourth or imaginary link is the "ground" or fixed distance between the pins 52 and 85.

However, a four-bar linkage will inherently have two dead spot alignments, i.e., an alignment such that no rotational vector is created to pivot the links relative to a force applied to one link. Since in this arrangement, the driven link, the link to which a force is applied, is the leg 66, such dead spot alignment would arise when the balancing leg 66 is at a minimum angle $\theta$ with a horizontal line through the armature pin 85 and the other links are in a position in which the handle pin 52, the pintle 96 and the pintle 92 are axially aligned. Another such dead spot alignment would arise when the angle $\theta$ is at a maximum and the other links are also in a position in which handle pin 52, the pintle 96 and the pintle 92 are axially aligned. These two dead spot alignments are not illustrated.

To assure that the four-bar linkage does not move into these two dead spot alignments, the mass 90 has a depressed portion defining a lower arcuate surface 130 and raised, spaced stop shoulders 132 and 134 at opposite ends which are perpendicular to the surface 130. A part of the link 100 closely overlies (but is spaced from) the surface 130 and is engagable with the stop shoulders 132 and 134.

When the armature leg 64 is fully unattracted, the position shown in FIG. 1, the cock's comb armature leg 81, FIG. 5, engages the frame horizontal leg 79 to limit rotation of the mass 90, but such engagement is not shown in FIG. 1 as it is hidden by a part of the frame 44 in this view. If the tolerance of the parts is such that the armature rotation is not so limited, then the surface 132 will engage the side of the link 100 and will limit the further rotation of the mass 90, keeping it from going into a dead spot alignment.

Thus, when the armature 60 is fully unattracted, as shown in FIG. 1, either the cock's comb 81 or the surface 132 abutting the side of the link 100, as shown, prevents the four-bar linkage from moving to the position where the angle $\theta$ would be a minimum (in which position the four-bar linkage would be in a dead spot alignment) and the linkage attains instead the position shown in FIG. 6.

When the armature 60 is fully attracted, as shown in FIG. 2, the surface 134 abuts the other side of the link 100, as shown, preventing the four-bar linkage from moving to the position where the angle $\theta$ would be a maximum (in which position the four-bar linkage would also be in a dead spot alignment) and the linkage attains instead the position shown in FIG. 7. (Because of the tolerances of the various parts, the link 100 and the mass 90 may continue moving slightly after the surface 134 engages the link 100 at which time the surface 136 forcefully engages a case wall portion 139, FIGS. 1 and 2. When the surface 134 forcefully engages the case wall portion 139, it dissipates the energy of the travelling mass 90 which, otherwise, would be transferred to the linkage mechanism 30 of the circuit breaker 10.).

The front side of the mass 90, as viewed in FIGS. 1, 2, and 4, also has a well 140 so as to place the pivotal connection between the link 100 and the pintle 96 as close as possible to the pintle 92, i.e., as close as practical to the plane of the leg 66. By so placing this pivotal connection, possible cocking of the mass 90 about the pintle 92 is minimized. The central part of the link 100 is bowed, as best shown in FIGS. 3 and 4, so that the left end of the link 100 abuts the frame 44 and the right end is seated against the mass 90 in the well 140. Further, a part of the link 100 closely overlies (but is spaced from) the arcuate surface 130, the link being bent to conform to the shape of the well 140 and the space available between the frame 44 and the adjacent half-case 19.

Referring to the relief 154 on the right side of the mass, as shown in FIG. 5, the relief 154 is provided merely to avoid possible interference with the adjacent portion of the handle 22 when the mass 90 is in certain positions.

From the foregoing, it is seen that when the armature 60 is attracted on sufficient overload from the position of FIG. 1 to the position of FIG. 2, the armature 60 pivots through one angle, but the mass 90 is forced to rotate through a much larger angle. Since the mass 90 rotates through a much larger angle during the same time that the armature 60 is rotating through a much smaller angle, the angular velocity of the mass 90 must be proportionately greater. That is, the energy on the armature tending to rotate the armature 60 must also rotate the mass 90 through a much larger angle. In addition to the rotation of the mass 90, the mass 90 is being simultaneously translated upwardly and to the left. The result of this rotation and translation of the mass 90 is that there is an expenditure of much greater energy than if the armature alone were being pivoted. This results in a much higher instantaneous overload current being required to rotate the armature. If this higher overload current does not persist for a sufficient long period of time, the armature is not rotated to the position where it will trip the latch 56. However, if a lower overload current does persist, it will attract (after a time delay period) the core (not shown) within the tube 76 toward the pole piece 70 sufficiently to increase the magnetic flux to the level where the leg 64 is pivoted by it to the position shown in FIG. 2.

It will be understood that when the four-bar linkage moves from the positions of FIGS. 1 and 6 to the positions of FIGS. 2 and 7, that an axial alignment of pins 85, 92 and 96 takes place, but since the force is being applied to the armature leg 66 and the four-bar linkage is in motion at this time, the linkage passes through this alignment without difficulties.

It will be understood that the larger the mass of the auxiliary inertial mass 90 and the greater the linkage multiplication factor between the pivotal movement of the armature 60 and the pivotal movement of the mass 90, the greater the current will be that is required to instantaneously trip the circuit breaker for a given circuit breaker.

Commercial needs required that the addition of the inertial mass 90 be made to existing circuit breaker designs. The mass 90 was therefore placed essentially in the plane of the leg 43 of the frame 44, FIG. 3, and so as to be between the leg 66 and the link 100 with the pivotal connections thereto on opposite sides of the mass 90. The shape of the mass 90, its placement on the leg 66, and the shape and placement of the link 100 were chosen so that a minimum of change would be required of the existing circuit breaker design. While the link 100 is shown with a particular shape and the mass 90 is shown with a particular configuration, it will be understood that these could be changed to suit the particular circuit breaker design within which this invention is used.

In one embodiment of this invention, the distance along the balancing leg 66 between the pin 85 and the pintle 92 is 0.500 inches, the distance along the link 100 between the pintle 96 and the pintle 52 is 0.552 inches, the distance along the mass 90 between the pintles 92 and 96 is 0.052 inches, and the distance between the pins 52 and 85 is 0.405 inches. In the initial position, the position of FIGS. 1 and 6, the angle $\theta$ is 65°. In the final position, illustrated in FIGS. 2 and 7, the angle $\theta$ is 80°. Thus, the armature 60 pivots counterclockwise through an angle of 15°. However, a plane in the mass 90 taken through the pintles 92 and 96 and represented by the arrow 170 will rotate counterclockwise through an angle of about 134°. Thus, the mass 90 will rotate through an angle which is about 9 times larger than the angle through which the armature 60 will rotate. While this specific example has been set forth, it is not intended that this invention be limited to the specific example given.

The addition of the mass 90 to the armature leg 66 slightly unbalances the armature about the pintle 85. But this unbalancing force on the armature is very small compared to the bias on the armature provided by the spring 83 and has no significant influence.

The mass 90 is, of course, also unbalanced relative to the axis through the pintle 92 which carries it on the leg 66. Since rotation of the mass 90 is restrained by the link 100, any residual force due to this unbalance is imposed through the pintle 92 and the pintle 96 on the leg 66 and the link 100 respectively.

That these two unbalanced aspects of the arrangement are insignificant is confirmed by tests which have shown that the variation in the minimum current required to trip the circuit breaker in the six possible mounting positions of the circuit breaker is only about 5%, which is well within commercial requirements and the unbalance introduced by the addition of the mass 90 is small enough to permit the use of the circuit breaker in all instances, except where excessive vibrational or shock forces are anticipated which might result in undesirable tripping of the circuit breaker.

It has also been found that if the link 100 is omitted and only the mass 90 is added to the balancing leg 66, a small increase will take place in the current which can be passed through the circuit breaker without substantially instantaneously tripping thereof, as compared to a circuit breaker without the additional mass.

However, it will also be understood that the auxiliary inertial mass 90 need not be carried by the armature 60. It could be pivotally mounted to the frame or to the case, but these alternatives are not illustrated. Further, while the link 100 has been illustrated as secured to a pin carried by the frame 44, i.e., the pin 52, the link 100 could also be arranged so as to be pivotally supported by the case 20 instead, but this is not illustrated.

From the foregoing, it is seen that the auxiliary mass 90 is rotated by the armature leg 66 about a pintle 96 when the armature leg 66 is pivoted by virtue of the pivotal connection 92 between the mass 90 and the armature leg 66, since the pintle 96 is carried by the link 100. The rotation of the mass 90 is at an angular velocity which is much greater than the angular velocity of the armature leg 66 because the link 100 is connected to a fixed reference point, the pin 52 carried by the frame 44, and the pintle 96 is spaced from the pintle 92 carried by the armature 60 a suitable distance thus defining another link formed by the part of the mass 90 between the pintles 92 and 96. The described arrangement defines what is known as a "four-bar linkage". By an appropriate choice of the relative linkage lengths, the angular velocity of the mass 90 will be many times that of the armature 60. Thus, the effective inertia of the armature 60 has been increased by the inertia of the mass 90 multiplied by the square of its angular velocity ratio to that of the armature. In addition, the fact that the armature 60 carries the auxiliary mass 90 results in an increase in the total inertia of the armature 60 by virtue of the added mass.

Tests of time delay circuit breakers constructed as disclosed herein for 60 Hertz alternating current have shown that overload currents of up to about 30 times rated current can be passed through the circuit breaker (without tripping the circuit breaker) if the overload current does not persist beyond one-half sine wave (0.0083 seconds). For overload currents persisting beyond one-half sine wave and up to about 100 milliseconds, the time delay periods are slightly increased in circuit breakers including this invention. If the overload currents persist beyond 100 milliseconds, it has been found that no substantial change takes place in the time delay periods of circuit breakers at such overload currents.

While not illustrated, if this invention is incorporated in a 60 Hertz alternating current circuit breaker without a time delay tube, i.e., one that is intended to trip on predetermined overload without an intentional time delay period, overload currents of short duration, i.e., lasting about one-half sine wave or less and of up to about 30 times rated current, will pass through the circuit breaker without tripping it. Predetermined overload currents persisting beyond about one-half sine wave, however, will cause the circuit breaker to trip substantially instantaneously.

It is seen from the foregoing that the high inrush characteristics of magnetic circuit breakers are enhanced significantly by this invention. Further this invention provides a reasonable cost additive modification to existing circuit breaker designs, although it is not restricted to existing designs and may readily be incorporated into new designs.

Having described this invention, what I claim is:

1. A circuit breaker comprising
a solenoid coil,
a pivotal armature actuatable by said coil,
a frame about said coil,
a tube surrounded by said coil,
a movable and magnetizable core within said tube,
means for retarding movement of said core and biasing said core toward one end of said tube,
said armature having an attractable leg, an unlatching leg, and a balancing leg,
a magnetizable pole piece secured to the end of said tube opposite to the end toward which said core is biased and toward which said attractable leg is movable,
a toggle linkage and latch mechanism,
said pole piece defining with said core a magnetic gap,
said pole piece defining with said attractable leg another magnetic gap,
said core being movable toward said pole piece,
further means biasing said attractable leg away from said pole piece and biasing said unlatching leg away from said latch mechanism,
an auxiliary inertial mass pivotally carried by said balancing leg, and
a link pivotally connected to said auxiliary inertial mass and also pivotally connected to a fixed support within said circuit breaker and proportioned and located so that a certain angular movement of said balancing leg results in a greater angular movement of said auxiliary inertial mass,
so that the current in the coil required to overcome the bias on said unlatching leg with substantially no time delay is substantially higher than the current required for a similar device but which omits said auxiliary inertial mass.

2. The combination of claim 1 wherein
said auxiliary inertial mass includes a first pintle rotatable with said mass and pivotally carried by said balancing leg, and a second pintle rotatable with said mass and pivotally connected to said link.

3. The combination of claim 2 wherein
said link is pivotally connected at a first end portion to said second pintle, and
said link is pivotaly mounted to said frame at a second end portion.

4. The combination of claim 3 wherein
a pin is carried by said frame and said link is pivotally mounted to said pin at its second end portion.

5. A circuit breaker comprising
a case,
a solenoid coil within said case,
an armature actuatable by said coil,
an operating mechanism,
said armature tripping said operating mechanism on predetermined overloads,
said armature being pivotal about a fixed axis within said case,
an auxiliary inertial mass housed within said case, linkage means within said case connected to said armature and to said mass and also connected to said mass and to a fixed support within said case whereby a certain angular movement of said armature requires a greatly multiplied angular movement of said mass, so that the current in the coil required to move said armature through a particular angle is substantially higher than the current required for a similar device but which omits said mass and said linkage means.

6. The combination of claim 5 wherein said linkage means comprises a first link rigidly connected at one end to said armature and pivotally connected to said mass at its other end, and a second link pivotally connected to a fixed support within said case at one end and pivotally connected to said mass at its other end, said pivotal connections at said mass being spaced from each other along said mass to thereby define a third link, whereby a four bar linkage is defined by said first, second and third links with the fourth link being an imaginary link extending between said fixed support and said fixed axis.

7. A circuit breaker comprising a case, a solenoid coil, an armature actuatable by said coil, an operating mechanism, said armature including a portion for tripping said operating mechanism and also including a balance portion, an auxiliary inertial mass carried by said balance portion, means biasing said armature away from said coil, and a link pivoted at a first portion to said auxiliary inertial mass, said link being pivotally mounted within said case at a second portion for rotating said auxiliary inertial mass at an angular velocity greater than the angular velocity of said armature, so that the current in the coil required to overcome the armature bias with substantially no time delay, at the maximum gap between said armature and said coil, is substantially higher than the current required for a similar device but which omits said auxiliary inertial mass.

* * * * *